US008985932B1

(12) United States Patent
Hawkins

(10) Patent No.: US 8,985,932 B1
(45) Date of Patent: Mar. 24, 2015

(54) MULTI-SILO ASPHALT DISTRIBUTION AND STORAGE SYSTEM

(76) Inventor: Michael R Hawkins, Kansas City, MO (US)

( * ) Notice: Subject to any disclaimer, the term of this patent is extended or adjusted under 35 U.S.C. 154(b) by 271 days.

(21) Appl. No.: 13/613,991

(22) Filed: Sep. 13, 2012

(51) Int. Cl.
*B65G 65/30* (2006.01)
*B65D 88/54* (2006.01)

(52) U.S. Cl.
CPC ..... *B65D 88/54* (2013.01)
USPC ..... 414/292; 414/293; 414/303; 222/160; 222/181.1; 222/185.1

(58) Field of Classification Search
USPC ..... 222/180, 181.2, 185.1, 160; 198/550.01, 550.02, 560
See application file for complete search history.

(56) References Cited

U.S. PATENT DOCUMENTS

| | | | | |
|---|---|---|---|---|
| 3,182,859 | A | 5/1965 | Harris et al. | |
| 3,305,138 | A | 2/1967 | Plumb | |
| 3,378,171 | A | 4/1968 | Eaton | |
| 3,438,520 | A | 4/1969 | Williams | |
| 3,647,047 | A | 3/1972 | Rheinfrank, Jr. | |
| 3,777,909 | A | 12/1973 | Rheinfrank, Jr. | |
| 3,934,739 | A | 1/1976 | Zumsteg et al. | |
| 3,999,668 | A | 12/1976 | Clements et al. | |
| 4,249,679 | A | 2/1981 | Dillman | |
| 4,260,312 | A * | 4/1981 | Hackney | 414/292 |
| 4,286,912 | A * | 9/1981 | Galow et al. | 414/287 |
| 4,339,203 | A * | 7/1982 | Murray | 366/9 |
| 4,427,133 | A * | 1/1984 | Kierbow et al. | 222/77 |
| 4,957,221 | A * | 9/1990 | Murray | 222/129 |
| 5,118,242 | A * | 6/1992 | Ebert et al. | 414/397 |
| 6,196,279 | B1 | 3/2001 | Baker | |
| 6,802,685 | B1 * | 10/2004 | Federhen | 414/292 |

* cited by examiner

*Primary Examiner* — Saul Rodriguez
*Assistant Examiner* — Ashley Romano
(74) *Attorney, Agent, or Firm* — Joseph B Bowman

(57) ABSTRACT

In a multi-silo distribution and storage system, the regions between the stationary and transport batchers, and between transport batcher and storage bin are isolated during asphalt discharge with a bellows automatically deployed when clam-shell gates of the stationary and transport batchers are opened. The storage bin is provided with a sealing door that lifts vertically for unsealing and slides horizontally to permit access to the bin interior for receiving asphalt discharged from the transport batcher. After registry above the top bin opening, the sealing door is forced downwardly to create a tight seal. For prolonged storage, a fluid seal isolates the lower discharge gate of the storage bin. Steam is delivered to the stored asphalt and bin interior to displace atmospheric oxygen vented through a valve in the bin top. An oxygen sensor linked to a process controller monitors the oxygen level within the storage bin.

6 Claims, 15 Drawing Sheets

34
46
60
42
40
38
36
30
44
78

44h
44g
44e
44f

MULTI-SILO ASPHALT DISTRIBUTION AND STORAGE SYSTEM

CROSS-REFERENCE TO RELATED APPLICATIONS

None

STATEMENT REGARDING FEDERALLY SPONSORED RESEARCH OR DEVELOPMENT

None

BACKGROUND OF THE INVENTION

This invention relates to equipment for distributing and storing large quantities of asphaltic mixtures in a multiple silo or bin system. More specifically, this invention relates to a multi-silo distribution and storage system to effectively control emissions during normal plant operations and to minimize degradation of asphaltic mixtures through oxidation during periods of prolonged storage.

Several techniques and numerous equipment arrangements for the preparation of asphaltic compositions are known from the prior art. Continuous production of asphalt compositions can be achieved, for example, with a drum mixer asphalt plant. Typically, water-laden virgin aggregates are dried and heated within a rotating, open-ended drum mixer through radiant, convective and conductive heat transfer from a stream of hot gases produced by a burner flame. As the heated virgin aggregate flows through the drum mixer, it is combined with liquid asphalt and mineral binder to produce various asphaltic mixtures as the desired end-product. Optionally, prior to mixing the virgin aggregate and liquid asphalt, reclaimed or recycled asphalt pavement (RAP) may be added once it is has been crushed or ground to a suitable size. The RAP is typically mixed with the heated virgin aggregate in the drum mixer at a point prior to adding the liquid asphalt and mineral fines.

In earlier times in this industry, one of the bottlenecks in paving construction had been trucking the asphalt mixtures from the production plant to the job site. In order to decrease the trucking expenses and also the waiting time of a truck at the production plant, temporary storage and loading facilities for asphalt plants were developed. Initially, such facilities included an elevating conveyor, such as the drag slat conveyor disclosed in Rheinfrank, Jr. U.S. Pat. No. 3,647,047, to receive asphalt mix from the production plant and to deliver it to the top of a large cylindrical silo supported above a truck load-out area. This type of temporary storage operation successfully reduced truck waiting time since a full truck load of asphalt mix was available when a truck arrived from the job site. In addition, by smoothing out loading times and enabling the orderly delivery of asphalt mix from the plant to the job site, fewer trucks were required for paving construction.

It was found, however, that the asphalt mixtures trickling into the large storage bin from the elevating conveyor caused separation of the aggregate within the mix which tended to roll to the outside of the cone of material within the bin. This problem was solved in the early 1970's with the development of the batcher as disclosed in Rheinfrank, Jr. U.S. Pat. No. 3,777,909. The batcher sat atop the storage silo and collected the asphalt mix from the elevating conveyor. When the batcher filled, its contents were then discharged to the larger storage silo. Segregation of the aggregate rock in the mix was avoided by dumping the larger volume of material into the storage silo at one time. Today, a batcher is found on most all asphalt storage silos specifically for the purpose of preventing segregation of the aggregate.

Over time, as asphalt production techniques and efficiencies improved, greater storage capacities were needed both for storing larger quantities of material and for storing asphalt mixes of differing compositions for various job applications. Storage facilities with multiple bin systems resulted and a variety of distribution schemes have been proposed. These include a separate batcher for each storage bin, multiple conveyors to deliver material to the many bins, and moving conveyors. One such example is taught in Harris U.S. Pat. No. 3,182,859.

A recent and simplified solution to the problem of multiple bin distribution and storage utilizes a stationary batcher to receive asphalt mix from the production plant and a transport batcher to receive mix from the stationary batcher and to then travel on an indexing rail system to deliver its load to a preselected one of several storage bins. It is this particular type of multi-silo distribution and storage system to which this invention specifically relates.

The asphalt industry has traditionally faced many environmental challenges. The asphalt production plant characteristically generates, as by-products, gaseous hydrocarbon emissions (known as blue-smoke), various nitrogen oxides ($NO_x$) and sticky dust particles covered with asphalt. Health and safety hazards resulted from the substantial air pollution control problems due to the blue-smoke produced when hydrocarbon constituents in the asphalt are driven off and released into the atmosphere. Within the asphalt production plant, exhaust gases are typically fed to air pollution control equipment such as a baghouse to filter particular matter from the exhaust gases. Thus, significant investments and efforts have previously been made by the industry in attempting to control emissions attributed to volatile hydrocarbon gases and particulates from the asphalt production plant itself.

Since the asphalt mix is typically delivered to the storage facilities as a hot or warm mixture, control of blue-smoke emissions from transferring equipment and from the storage bins themselves continue to be problematic. The asphaltic mixtures are exposed to atmospheric conditions when transferring mix from the stationary batcher to the transport batcher, and again when transferring mix from the transport batcher to the storage bin. The escape of volatile hydrocarbon emissions during these operational steps is inevitable.

Emissions also occur from the storage bin itself due to inadequate sealing of the upper access door of the bin and leakage around the lower discharge gate. During periods of prolonged storage of asphalt mixes, emissions from the storage bin continue as a result of the need for maintaining the storage material at elevated temperatures through various heating and/or insulation techniques. Volatiles from the mixes are therefore present and can escape around the lower discharge gate and upper access door of the storage bin.

Dillman U.S. Pat. No. 4,249,679 has proposed a seal for the lower discharge gate having a sliding door and a dispensing system to pump grease around the door and the discharge mouth of the storage bin. This was a cumbersome solution and was never widely accepted in the asphalt industry. Heretofore no solutions have been found to effectively and positively seal the upper access door of the bin.

In addition to the concerns over emissions during prolonged storage of asphalt mixes, degradation of the asphalt through oxidation has long been a problem. Clements et al U.S. Pat. No. 3,999,688 proposed an inerting system using tanks of carbon dioxide gas with a self-sealing top access door. However, the access door lacked any means to forcibly seal the upper opening and the inerting system was never widely adopted in the industry as a result of the maintenance issues associated with the need for an inventory of carbon dioxide tanks and frequent change out of the tanks in service.

A need remains in the asphalt industry for an improved multi-silo distribution and asphalt storage system to effectively control blue-smoke emissions, to provide positive seals for the upper access door and the discharge gate of a storage bin, and to provide a useful inerting system to minimize degradation of asphaltic mixtures through oxidation during periods of prolonged storage. The primary objective of this invention is to meet these needs.

BRIEF SUMMARY OF THE INVENTION

An object of the invention is to provide multi-silo distribution and storage facilities to effectively control blue-smoke emissions by isolating from the environment the discharges of both the stationary and transport batchers.

Another object of the invention is to provide multi-silo distribution and storage facilities of the character described where the region between the stationary batcher and the transport batcher and the region between the transport batcher and the storage bin are effectively isolated by a flexible bellows to contain blue-smoke emissions during discharge of asphalt mix from the stationary and transport batchers.

A further object of the invention is to provide multi-silo distribution and storage facilities of the character described where the flexible bellows associated with the stationary and transport batchers are automatically deployed to contain blue-smoke emissions whenever the clamshell gates of the stationary and transport batchers are opened.

Another object of the invention is to provide multi-silo distribution and storage facilities with a self-sealing top access door on the storage bin.

Yet another object of the invention is to provide multi-silo distribution and storage facilities with a self-sealing top access door to be forced downwardly to create a tight, positive seal and to be movable upwardly and then slid horizontally to provide access to the interior of the storage bin.

A further object of the invention is to provide multi-silo distribution and storage facilities with a fluid seal on the discharge gate of the storage bin to prevent emissions leakage therefrom and to isolate the bin contents from atmospheric oxygen.

An additional object of the invention is to provide multi-silo distribution and storage facilities of the character described having an effective seal to the top access door and an effective seal to the lower discharge gate, and further equipped with an inerting system to minimize oxidation of the asphaltic mixtures during prolonged periods of storage.

Yet another object of the invention is to provide multi-silo distribution and storage facilities equipped with an inerting system of the character described which is economical in operation and includes an oxygen sensor to monitor oxygen levels within the storage bin and a process controller to deliver steam to the interior of the storage bin when an excessive level of atmospheric oxygen is sensed.

Other and further objects of the invention, together with the features of novelty appurtenant thereto, will appear in the detailed description of the drawings.

In summary, a multi-silo distribution and storage system where the region between the stationary batcher and transport batcher and the region between the transport batcher and the storage bin are isolated during the discharge of asphalt mix with a bellows that is automatically deployed when the clamshell gates of the stationary and transport batchers are opened. Access to the interior of the storage bin is provided by a sealing door that lifts vertically for unsealing and then slides horizontally to the side to permit access to the bin for receiving asphaltic mixtures discharged from the transport batcher. After moving to registry above the top opening of the bin, the sealing door is forced downwardly to create a tight, positive seal. For prolonged periods of storage, in addition to a positive seal for the upper access of the storage bin, a fluid seal isolates the lower discharge gate of the storage bin. Thereafter, a steam generator delivers steam to the stored asphaltic mix and to the interior of the storage bin to displace atmospheric oxygen vented through a vent valve in the top of the bin. An oxygen sensor linked to a process controller monitors the oxygen level within the storage bin for operation of the steam generator.

BRIEF DESCRIPTION OF THE SEVERAL VIEWS OF THE DRAWING

In the following description of the drawings, in which like reference numerals are employed to indicate like parts in the various views.

DETAILED DESCRIPTION OF THE INVENTION

Figure 1:
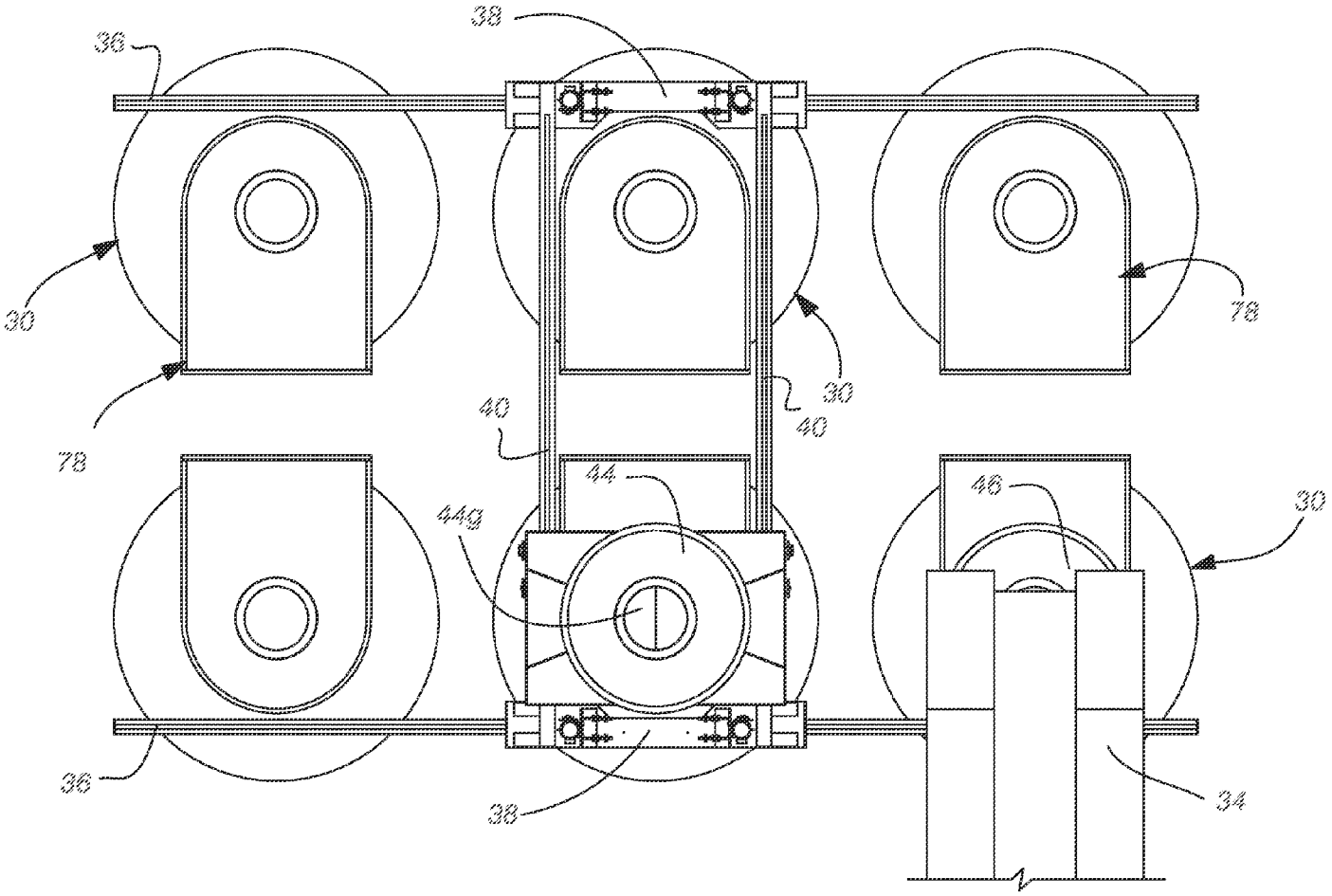
FIG. 1 is a top plan view of a multi-silo asphalt storage and distribution system showing six storage silos, portions of a drag slat conveyor, a stationary batcher, and a transport batcher.
Figures 2, 2A:
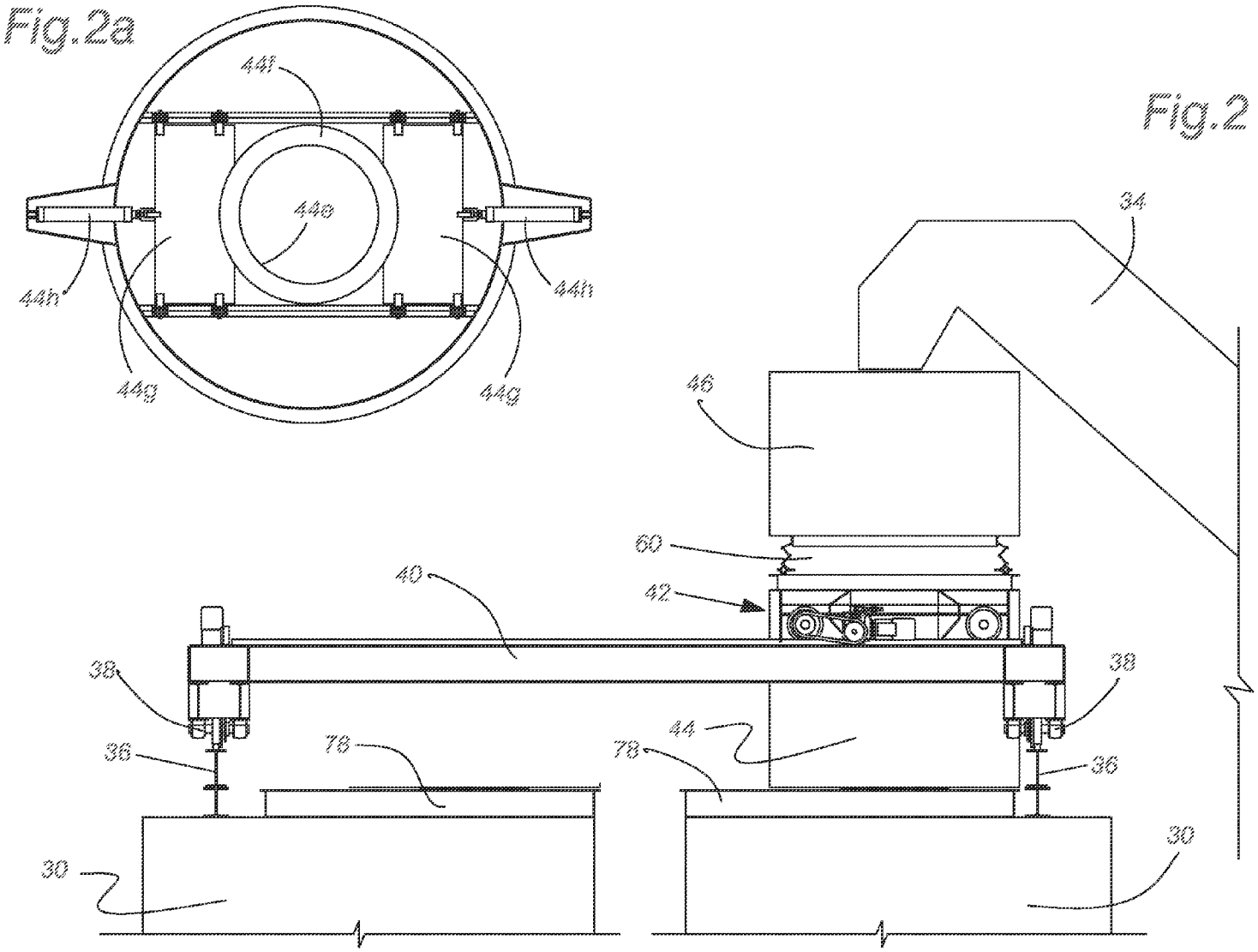
FIG. 2 is an end elevational view of a multi-silo asphalt storage and distribution system showing the transport batcher positioned beneath the stationary batcher.
FIG. 2*a* is an enlarged, top plan view of the transport batcher with the movable central doors shown in the open position to access the interior of the batcher.
Figure 3:
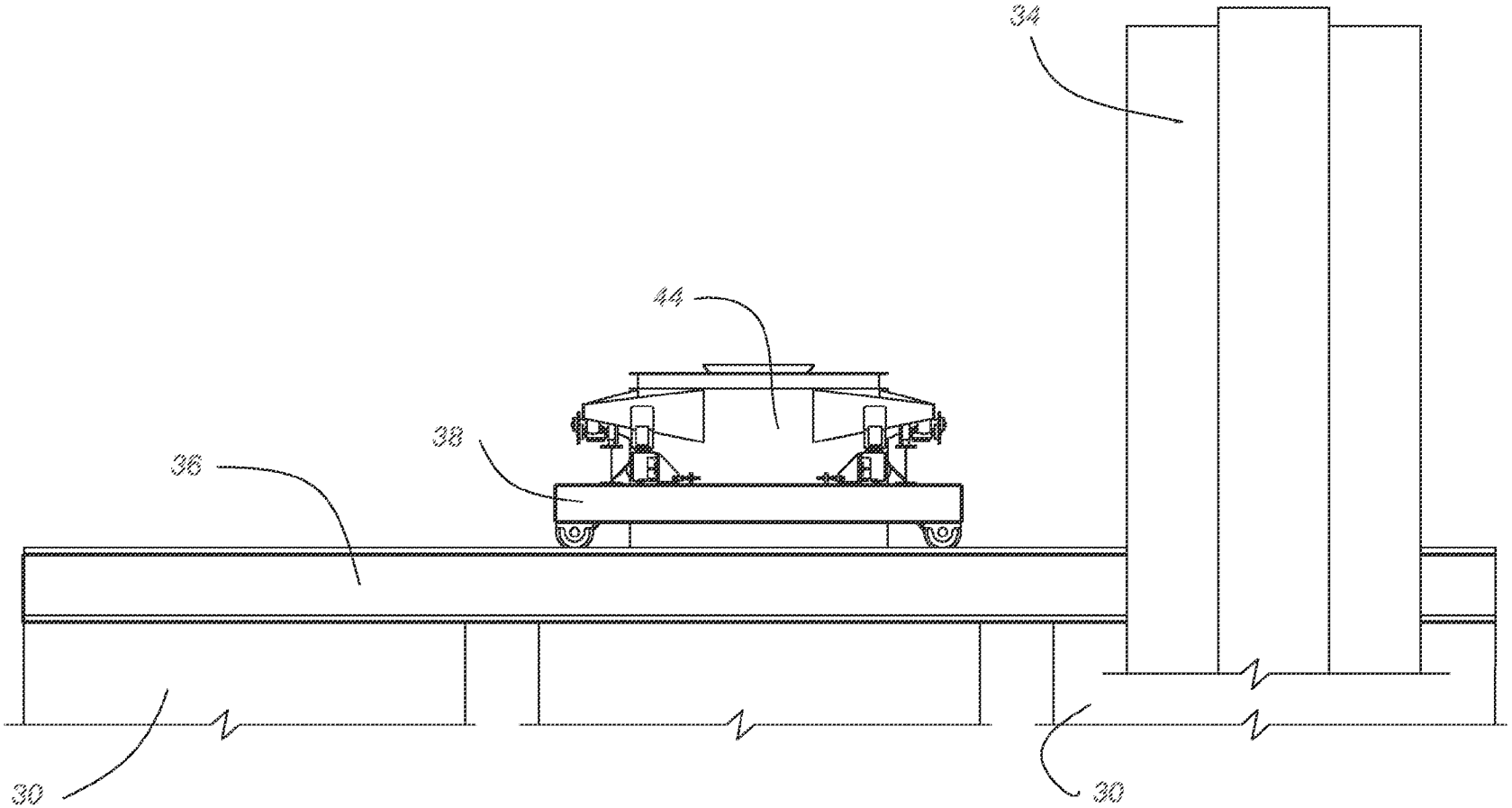
FIG. 3 is a side elevational view of a multi-silo asphalt storage and distribution system showing the transport batcher moved from the stationary batcher and positioned above the access door of a storage silo.

Referring now to the drawings in greater detail, attention is first directed FIGS. 1-3 illustrating a multi-silo distribution and storage system specific to this invention. Illustrated in FIG. 1 is a plurality of storage bins 30. Although six such bins 30 are shown, this number can be expanded or contracted to any convenient number. Each storage bin 30 has a large, cylindrical upper portion 30*a* joined to a lower frusto-conical portion 30*b* with a central discharge mouth 30*c* with a discharge gate 30*d* for holding asphaltic mixtures 32 within the storage bin 30. The storage bins 30 are vertically oriented and supported on legs above a truck load-out area (not shown). Such support is well known in the art and a representative example thereof is shown in Rheinfrank, Jr. U.S. Pat. No. 3,777,909 which is incorporated by reference.

Asphaltic mixtures from a production plant (not shown) are characteristically delivered to storage facilities by means of a drag slat conveyor 34 of which the upper portion thereof is illustrated in the drawings. Further details of a typical drag slat conveyor useful for transferring asphaltic mixtures from a production plant to storage facilities is shown in Rheinfrank, Jr. U.S. Pat. No. 3,647,047 which is incorporated by reference.

Also known in the art and mounted atop the storage bins 30 is an indexing mechanism which includes spaced apart, parallel rails 36 attached to the bins 30 along the lengths of opposed rows of bins 30. Supported on each rail 36 is a power operated wheeled carriage 38 for coordinated movement along the rail 36. Attached to the carriages 38 are spaced apart, parallel rails 40 oriented substantially perpendicular to the rails 36. Supported on each rail 40 is a power operated wheeled carriage 42 for coordinated movement along the rail 40. Attached to the carriages 42 is a transport batcher 44, the details of which will be discussed shortly. Thus constructed, the indexing mechanism is adapted to move the transport batcher 44 back and forth over the bins 30 (in the "x-direction" relative to FIG. 1) on the rails 36 by operation of the carriages 38, and is adapted to move the transport batcher 44 back and forth over the bins 30 (in the "y-direction" relative to FIG. 1) on the rails 40 by operation of the carriages 42. Therefore, the transport batcher 44 can be caused to selectively register over each of the bins 30 in the storage facilities.

As shown in FIGS. 1 & 2, beneath the discharge of the drag slat conveyor 34 is mounted a stationary batcher 46 to receive asphaltic mixtures from the conveyor 34 and then to discharge the asphaltic mixtures to the transport conveyor 44 when the transport conveyor 44 registers over the first bin 30 and under the stationary batcher 46. The essential details of construction of the transport batcher 44 are illustrated in FIGS. 4-7. The stationary batcher 46 has the same construction as the transport batcher 44 and, therefore, is not separately illustrated.

The transport batcher 44 includes a cylindrical upper portion 44*a* having a diameter much smaller than that of the storage bin 30 and a lower frusto-conical portion 44*b* terminating in a circular discharge mouth 44*c*. As best shown in FIG. 2*a*, the top of the batcher 44 includes a cover plate 44*d* having a central opening 44*e* fitted with an inlet cone 44*f*. Beneath the cover plate 44*d*, central opening 44*e* and the inlet cone 44*f* are a pair of movable central doors 44*g* equipped with extendable and retractable cylinders 44*h* to provide access to the interior of the batcher 44.

Figure 4:
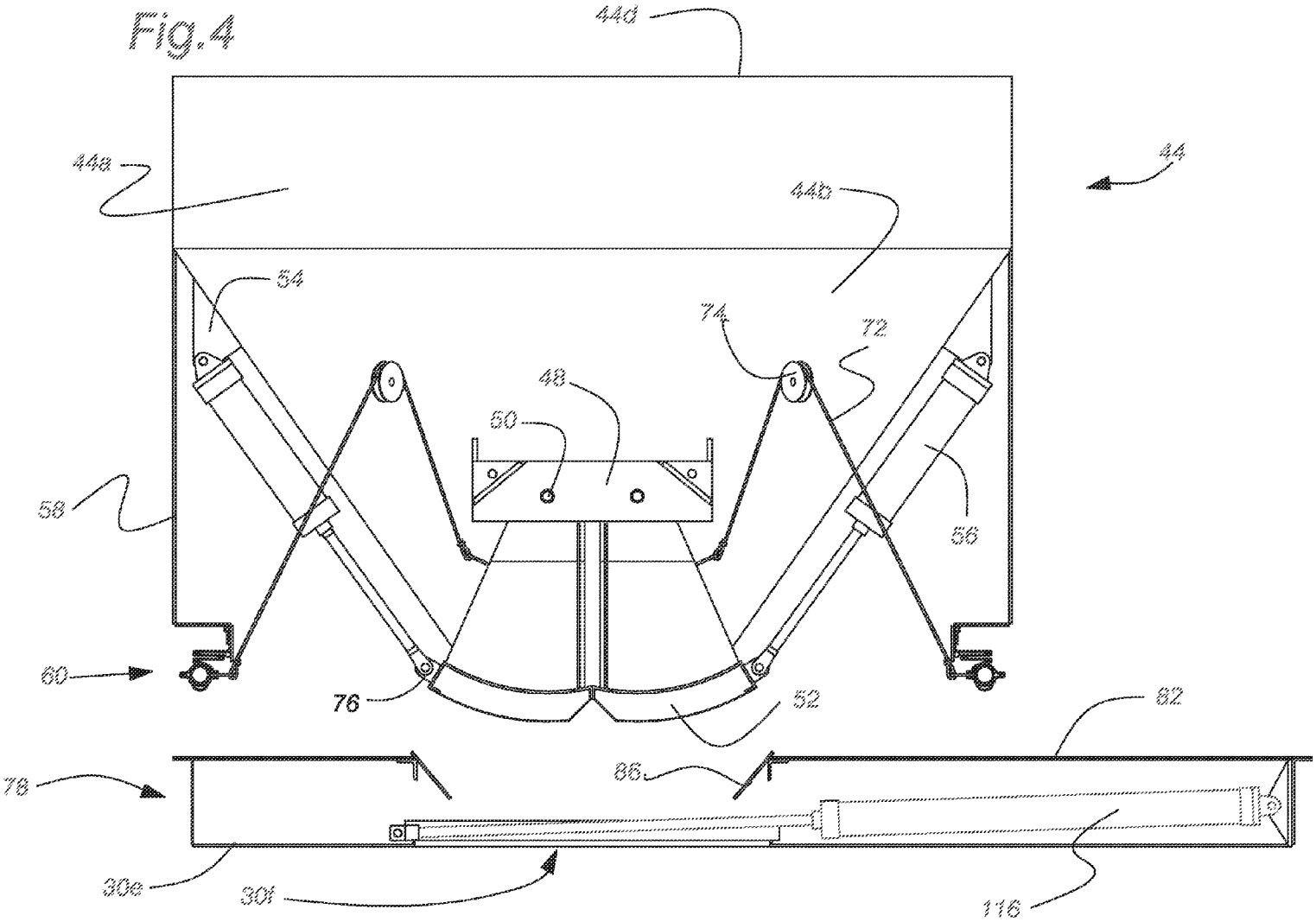
FIG. 4 is a side elevational view of the transport batcher positioned above the access door of a storage silo prior to discharge of the asphalt contents of the transport batcher to the storage silo.

At diametrically opposed locations on the exterior surface of the frusto-conical portion 44*b* are affixed gate brackets 48 which carry pivot pins 50 to support clamshell gates 52 that normally close the discharge mouth 44*c* as shown in FIG. 4.

Figure 6:
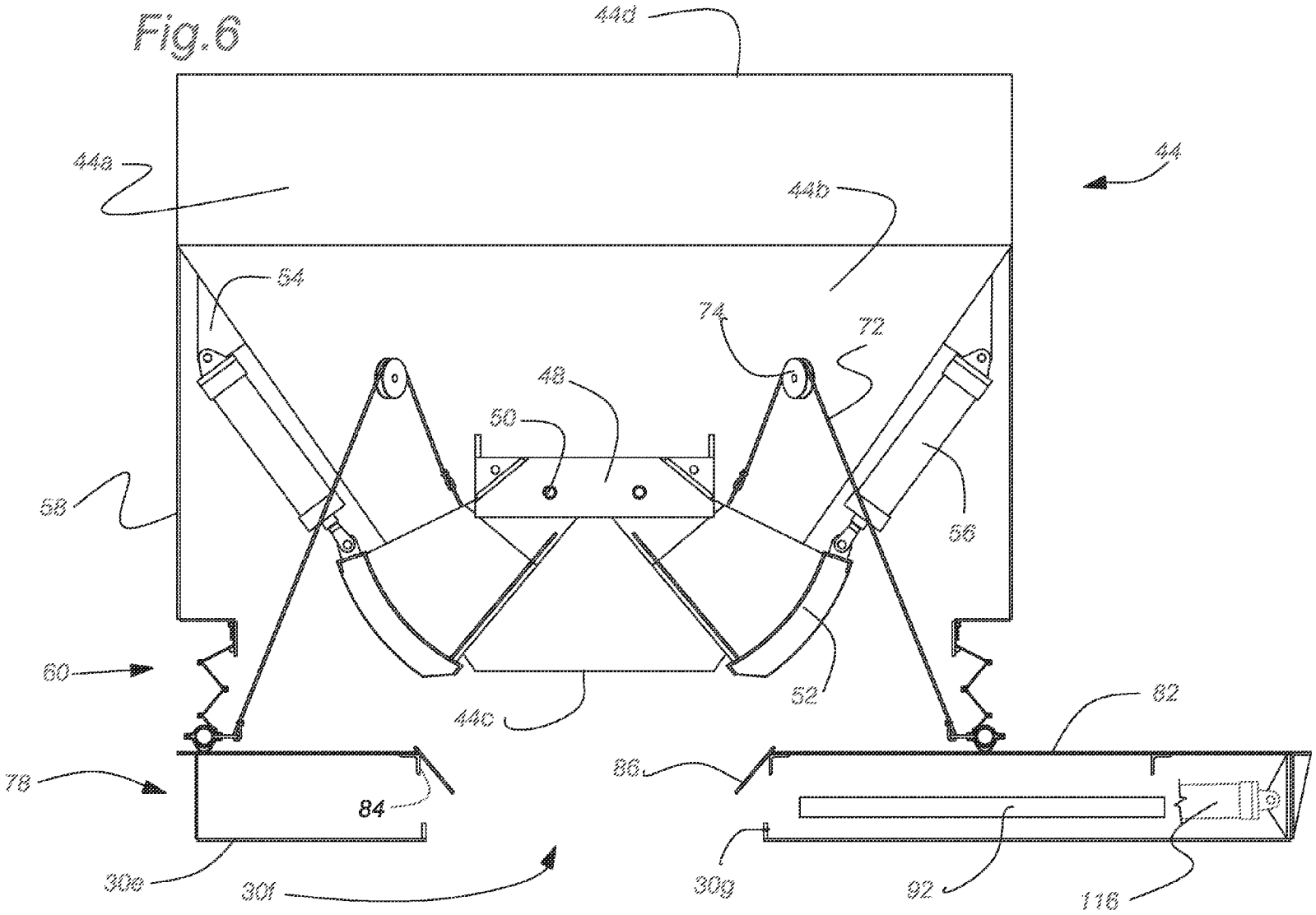
FIG. 6 is a side elevational view of the transport batcher positioned above the access door of a storage silo similar to FIG. 4 but showing the access door of the storage silo open and the batcher discharge gates open with a bellows seal engaged against the housing of the access door of the storage silo when asphalt contents of the transport batcher are delivered to the storage silo.
Figure 7:
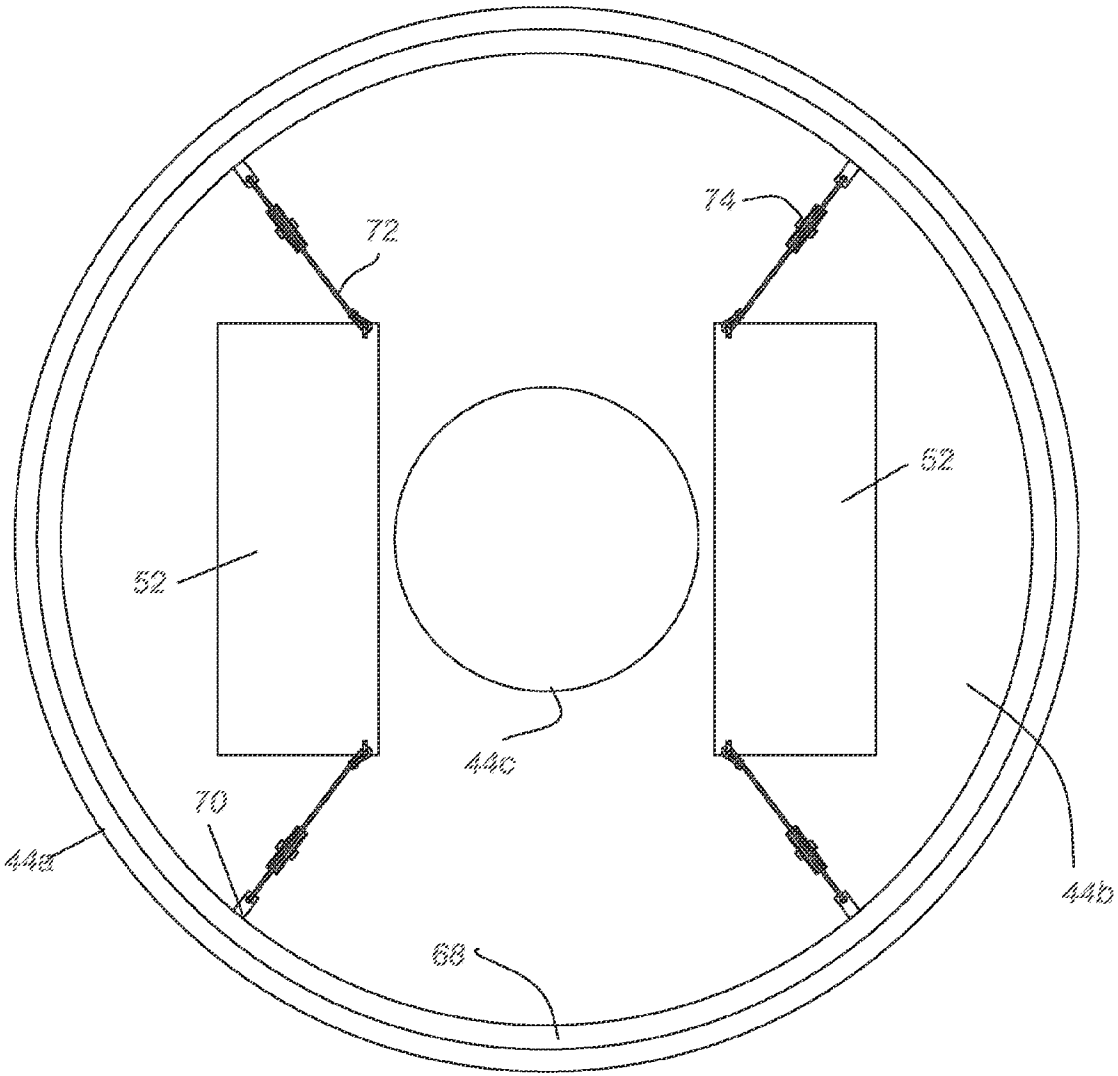
FIG. 7 is a bottom plan view of the transport batcher similar to FIG. 5 positioned above the access door of a storage silo but showing the batcher discharge gates open to discharge of the asphalt contents of the transport batcher to the storage silo.

Also attached to the exterior surface of the frusto-conical portion 44*b*, at diametrically opposed locations that are substantially perpendicular to the diameter on with the gate brackets 48 are attached, are cylinder brackets 54. Extendable and retractable cylinders 56 are pivotally pinned between the brackets 54 and the clamshell gates 52. When extended, the cylinders 56, which can be hydraulically or pneumatically operated, cause the clamshell gates 52 to close the batcher mouth 44*c* as shown in FIG. 4. When retracted, however, the cylinders 56 pivot the clamshell gates 52 to open the batcher mouth 44*c* as shown in FIGS. 6 & 7.

The foregoing details of batcher construction are well known to those skilled in the art of asphalt storage. The transport batcher 44 and stationary batcher 46 of this invention, however, further include a cylindrical shroud 58 attached to the upper cylindrical portion 44*a* and substantially enclosing the frusto-conical portion 44*b* and portions of the clamshell gates 52.

Figure 5:
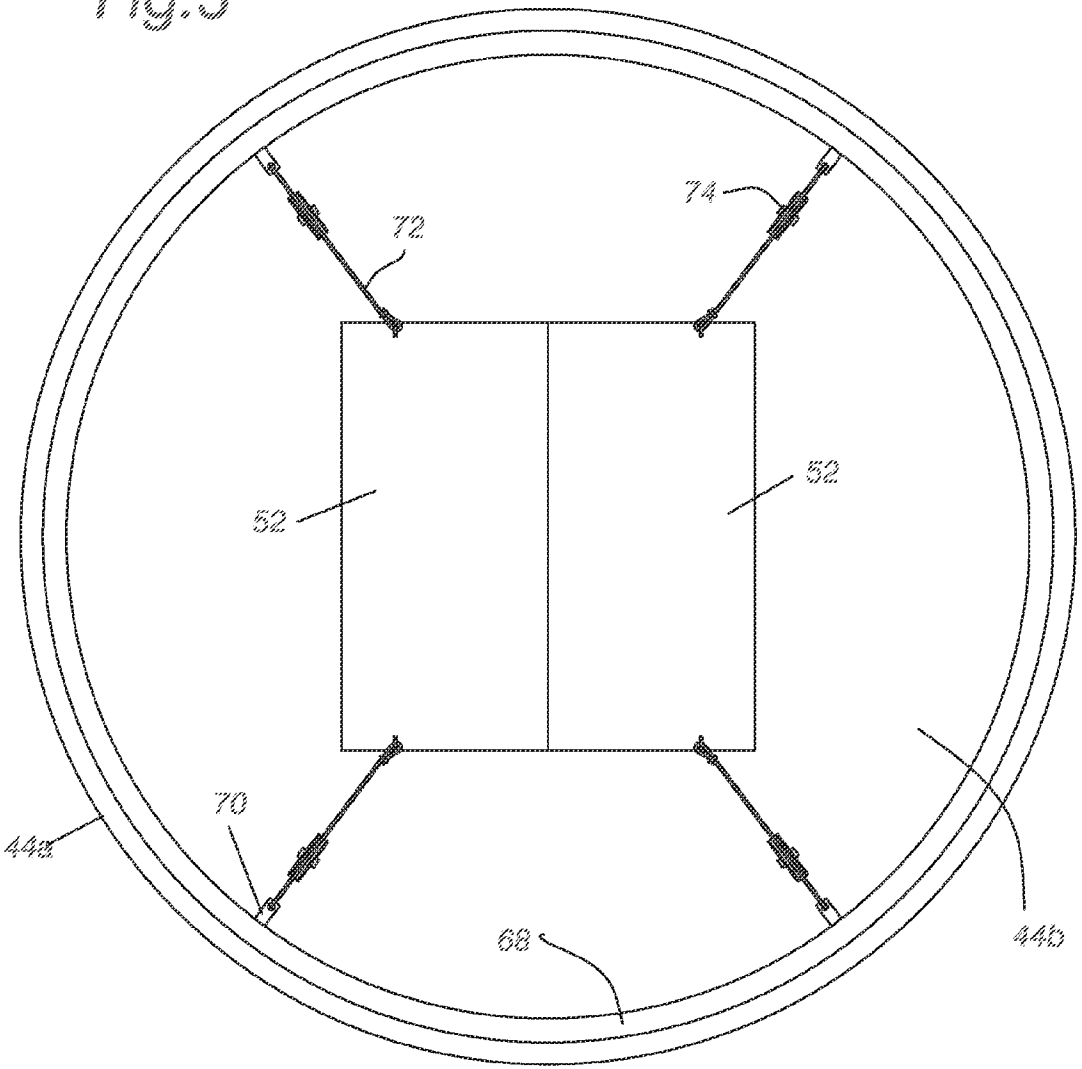
FIG. 5 is a bottom plan view of the transport batcher shown in FIG. 4 (with cylinders and brackets removed for clarity) positioned above the access door of a storage silo prior to discharge of the asphalt contents of the transport batcher to the storage silo.
Figure 4A:
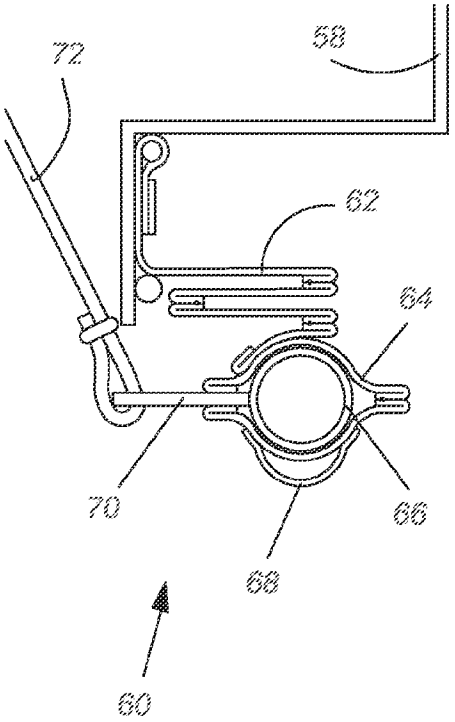
FIG. 4*a* is an enlarged, sectional fragmentary view of the bellows as shown in FIG. 4.

Attached to the lower end of the shroud 58 is a cylindrical bellows 60. As best viewed in FIG. 4*a*, the bellows 60 is constructed with a flexible accordion material 62 with a cuff 64 formed in the lower end of the accordion material 62. Within the cuff 64 is carried a weighted hoop 66. Attached to the lowermost surface of the cuff 64 is a compressible seal strip 68. Four brackets 70 are connected to the cuff 64 and weighted hoop 66 at spaced locations around the lower end of the bellows 60 as shown in FIG. 5. Secured to each bracket 70 is a flexible cable 72 which extends over a pulley 74 mounted within the shroud 58 and is secured to a connector 76 attached to the clamshell gates 52. The length of each such cable 72 is adjusted during installation thereof such that when the clamshell gates 52 close (FIG. 4), the cable 72 pulls the bellows 60 upwardly so the accordion material 62 folds against the shroud 58. When the clamshell gates 52 open, however, the weighted hoop 66 within the cuff 64 causes the accordion material 62 to unfold by gravity downwardly. In the case of the transport batcher 44, this action causes the sealing strip 68 at the lower edge of the bellows 60 to seal against the top closure surface of the storage bin 30. In the case of the stationary batcher 46, this same action causes the sealing strip 68 at the lower edge of the bellows 60 to seal against the cover plate 44*d* of the transport batcher 44.

The upper end of each storage bin 30 is closed by a circular closure top 30*e* secured to the cylindrical portion 30*a*. Positioned in the circular top 30*e* is a central opening 30*f* through which access is provided to the interior of the storage bin 30. Mounted atop each of the storage bins 30 is a self-sealing closure door assembly referenced generally by the numeral 78 in FIGS. 1-3. Attention is next directed to FIGS. 8-11 of the drawings for additional general details of the closure door assembly 78.

Figure 8:
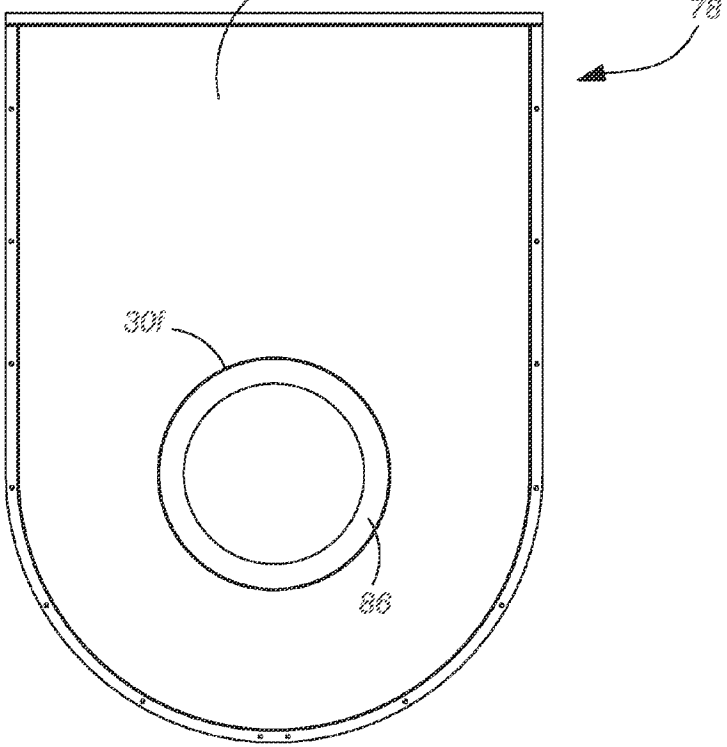
FIG. 8 is a top plan view of the access door housing of a storage silo.
Figure 9:
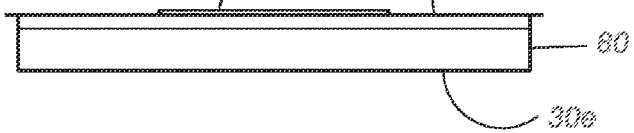
FIG. 9 is a side elevational view of the access door housing of a storage silo shown in FIG. 8.
Figure 12:
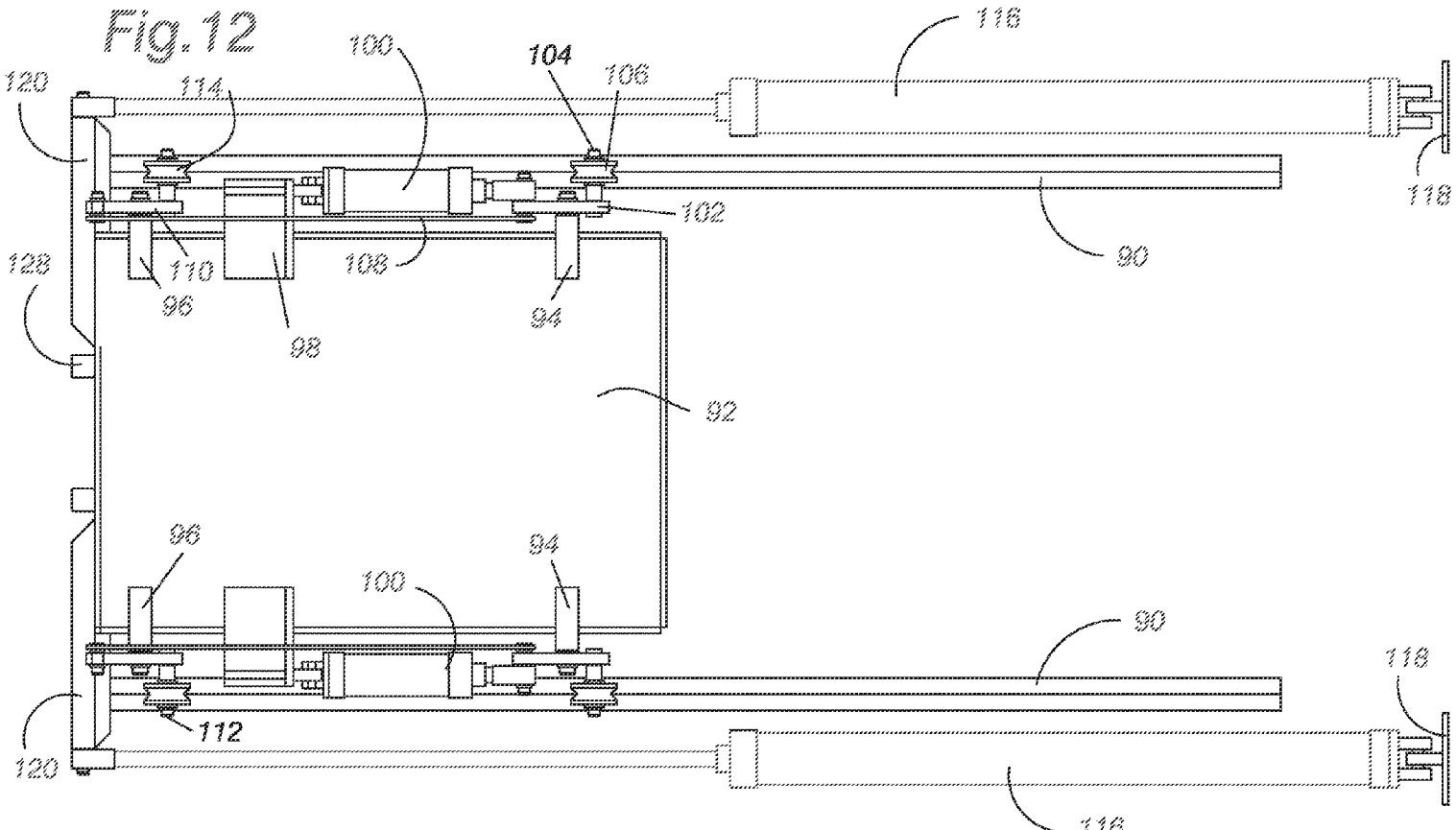
FIG. 12 is a top plan view of the access door of a storage silo shown in the closed and sealed position.
Figure 13:
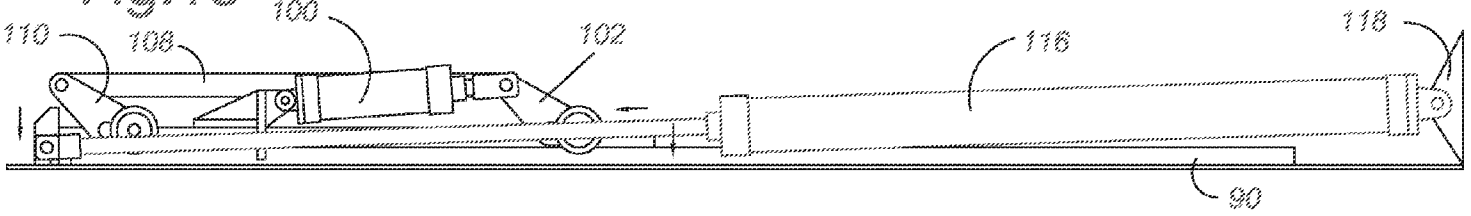
FIG. 13 is a side elevational view of the access door as shown in FIG. 12 in the closed and sealed position.
Figure 14:
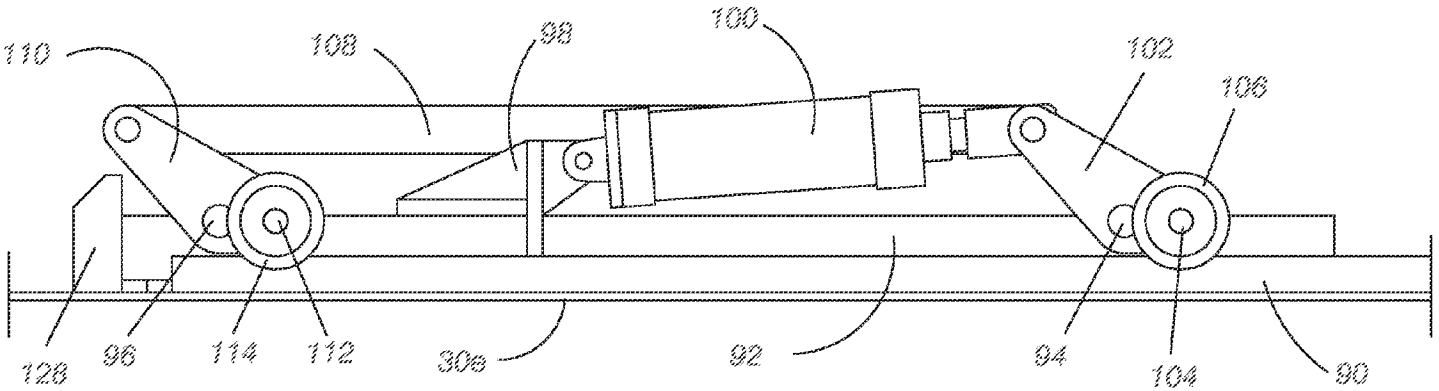
FIG. 14 is an enlarged, side elevational view of the portion of the access door as shown in FIG. 13 in the closed and sealed position.

As shown in FIGS. 8 & 9, each door assembly 78 includes a housing formed from a short side wall 80 secured to the closure top 30*e* of the storage bin 30 on which is attached a top plate 82. The top plate 82 includes a circular opening 84 fitted with a funnel 86 to register with the central opening 30*f* of the storage bin (see FIGS. 4 & 6).

Alternatively, for ease of fabrication and separate shipment as in the case of a retrofit for a storage bin, each door assembly 78 can include a bottom plate to which the short side wall 80 is attached, and then the bottom plate itself can be secured to the closure top 30*e* of the storage bin 30. In such alternative construction, the bottom plate of the door assembly 78 includes a circular opening to register with the central opening 30*f* of the storage bin 30.

Figure 10:
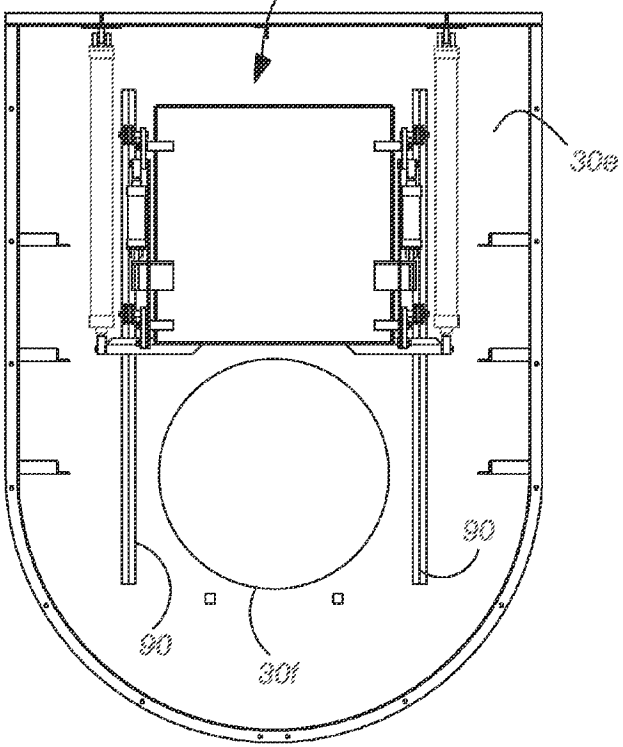
FIG. 10 is a top plan view similar to FIG. 8 but with the top panel of the access door housing removed to illustrate the access door itself shown in an open position.
Figure 11:
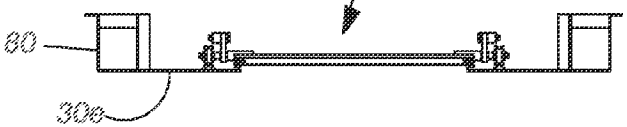
FIG. 11 is a side elevational view similar to FIG. 9 but with the top and end panels of the access door housing removed to illustrate the access door itself.

Beneath the top plate 82 is housed a movable door assembly 88 carried on a pair of parallel tracks 90 mounted on the closure top 30*e* on opposite sides of the central opening 30*f* of the storage bin 30 as generally illustrated in FIGS. 10 & 11 with the top plate 82 removed. FIG. 10 shows a top plan view with the movable door assembly 88 removed from the central opening 30*f* of the storage bin 30 while FIG. 11 shows a side elevational view with the movable door assembly 88 sealed against the central opening 30*f*.

Details of the construction and operation of the movable door assembly 88 are illustrated in FIGS. 12-21. A sealing door panel 92 is positioned between the tracks 90. Attached to the upper surface of the door panel 92 on opposite sides thereof are a pair of spaced apart first and second pivot pins 94 & 96 which extend outwardly from the door panel 92 toward but terminate short of the tracks 90. Between each pair of pivot pins 94 & 96 is a cylinder bracket 98 secured to the upper surface of the door panel 92. One end of an extendable and retractable cylinder 100 is pivotally pinned to the cylinder bracket 98. The opposite end of the cylinder 100 is pivotally pinned to one end of a first cam arm 102. The opposite end of the first cam arm 102 is connected to a shaft 104 which extends over one of the tracks 90 and carries a rotatable v-groove wheel 106. Intermediate the ends of the first cam arm 102, between the pinned connection with the cylinder 100 and the connection with the shaft 104, the first cam arm 102 pivotally receives the pivot pin 94 extending from the door panel 92.

Also pivotally coupled to the connection between the cylinder 100 and the first cam arm 102 is one end of a linkage bar 108. The opposite end of the linkage bar 108 is pivotally pinned to one end of a second cam arm 110 having the same configuration as the first cam arm 102. The opposite end of the second cam arm 110 is connected to a shaft 112 which extends over one of the tracks 90 like shaft 104 and carries a rotatable v-groove wheel 114. Intermediate the ends of the second cam arm 110, between the pinned connection with the linkage bar 108 and the connection with the shaft 112, the second cam arm 110 pivotally receives the pivot pin 96 extending from the door panel 92.

Positioned alongside the tracks 90 are a pair of elongate, extendable and retractable cylinders 116. One end of the cylinder 116 is pivotally pinned to a mounting bracket 118 secured to the short side wall 80 of the closure door assembly 78. The opposite end of the cylinder is pivotally pinned to a bracket 120 attached to the sealing door panel 92 on the leading edge thereof.

Thus constructed, the cylinders 100 are adapted to move the sealing door panel 92 vertically up and down and the elongate cylinders 116 are adapted to move the door panel 92 horizontally on tracks 90 when the door panel 92 is elevated.

Figure 15:
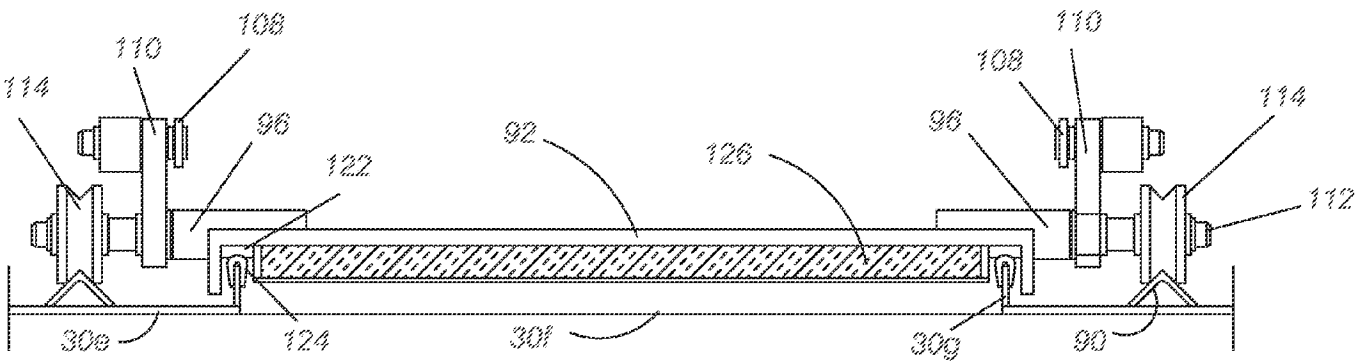
FIG. 15 is an end view, partially sectional, of the access door as shown in FIG. 14 in the closed and sealed position.
Figures 16, 17:
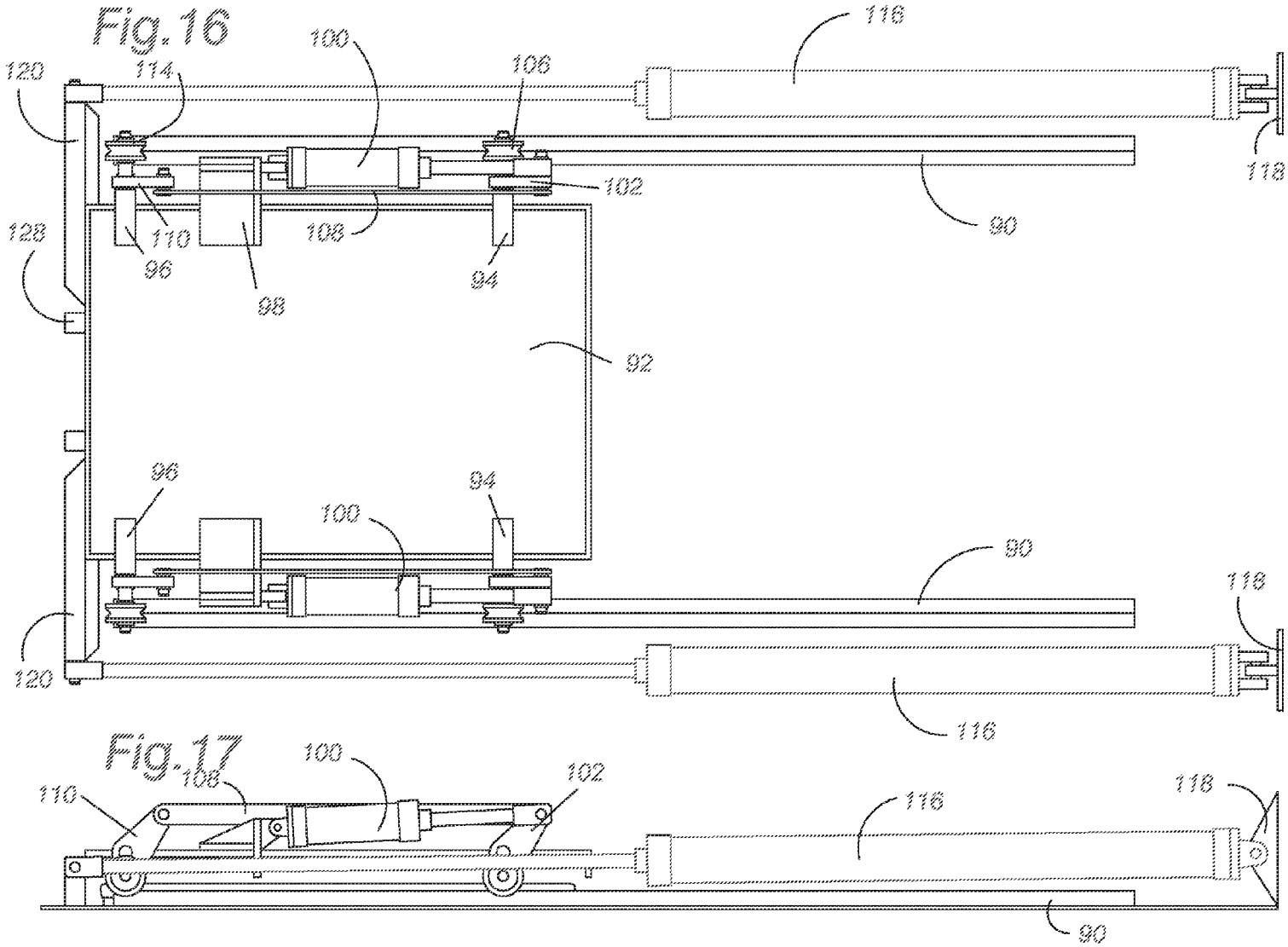
FIG. 16 is a top plan view similar to FIG. 12 but showing the access door in a position raised above the sealed position.
FIG. 17 is a side elevational view similar to FIG. 13 but showing the access door in a position raised above the sealed position.
Figure 18:
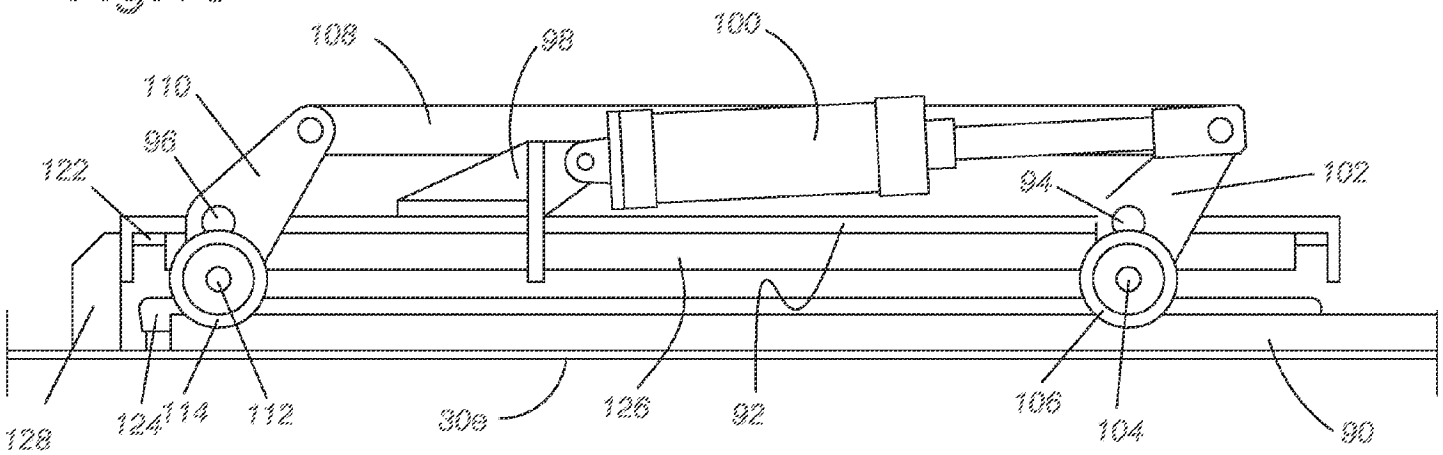
FIG. 18 is an enlarged view similar to FIG. 14 but showing the access door in a position raised above the sealed position.
Figure 19:
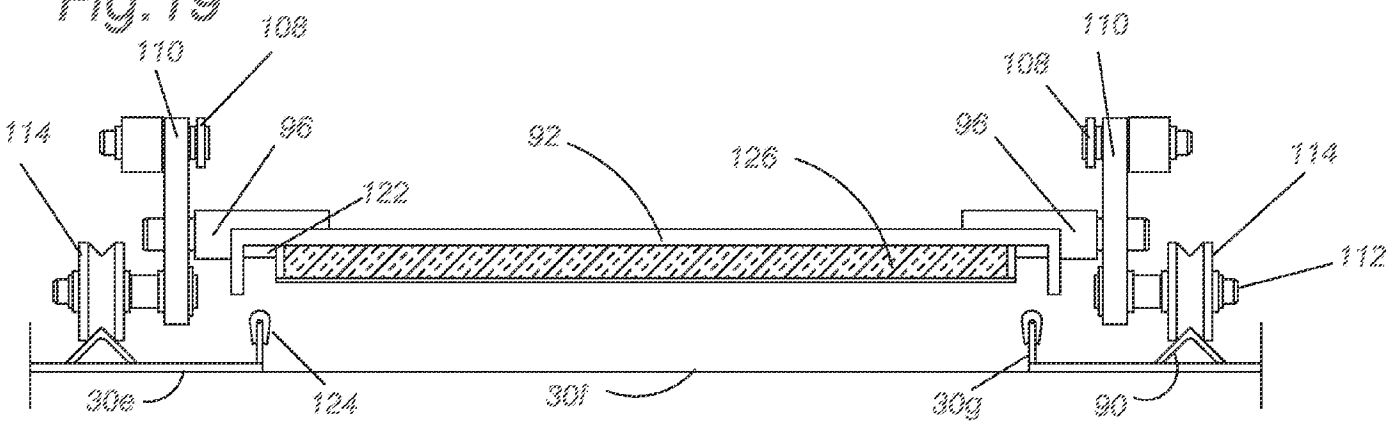
FIG. 19 is an end view, partially sectional, of the access door as shown in FIG. 15 but showing the access door in a position raised above the sealed position.

As shown in FIGS. 15 & 19, the undersurface of the sealing door panel 92 is equipped with a compressible sealing gasket 122 around the perimeter of the door panel 92. An upstanding lip 30*g* frames the central opening 30*f* of the storage bin 30 and is fitted with a u-shaped cushion strip 124 to mate with the sealing gasket 122. The undersurface of the door panel 92 may also include an insulation layer 126.

The sealed position is illustrated in FIGS. 12-15. With the elongate cylinders 116 fully extended, the door panel 92 is positioned above the central opening 30*f* of the storage bin 30 and registers with the frame of the upstanding lip 30*g*. The cylinders 100 are fully retracted in the sealed position. Retraction of the cylinders 100 forces the first cam arm 102, and also the second cam arm 110 through linkage bar 108, in the direction of the leading edge of the door panel 92. That is to say, both the first and second cam arms 102 & 110 are forced to the left as viewed in FIGS. 12-14. This action causes both sets of pivot pins 94 & 96 connected to the first and second cam arms 102 & 110 to move downwardly to bias the sealing gasket 122 to engagement with the cushion strip 124 on the upstanding lip 30*g* to tightly seal the central opening 30*f* of the storage bin 30.

Elevating the door panel 92 above its sealed position is illustrated in FIGS. 16-19. The cylinders 100 are actuated to fully extend. Extending the cylinders 100 forces the first cam arm 102, and also the second cam arm 110 through linkage bar 108, in a direction away from the leading edge of the door panel 92. That is to say that both the first and second cam arms 102 & 110 are forced to the right as viewed in FIGS. 16-18. This action causes both sets of pivot pins 94 & 96 connected to the first and second cam arms 102 & 110 to move upwardly and elevate the door panel 92 away from a position sealing the central opening 30*f* of the storage bin 30. The elongate cylinders 116 pivot up slightly as the door panel is elevated which can be understood by comparing FIGS. 13 & 17.

Figure 20:
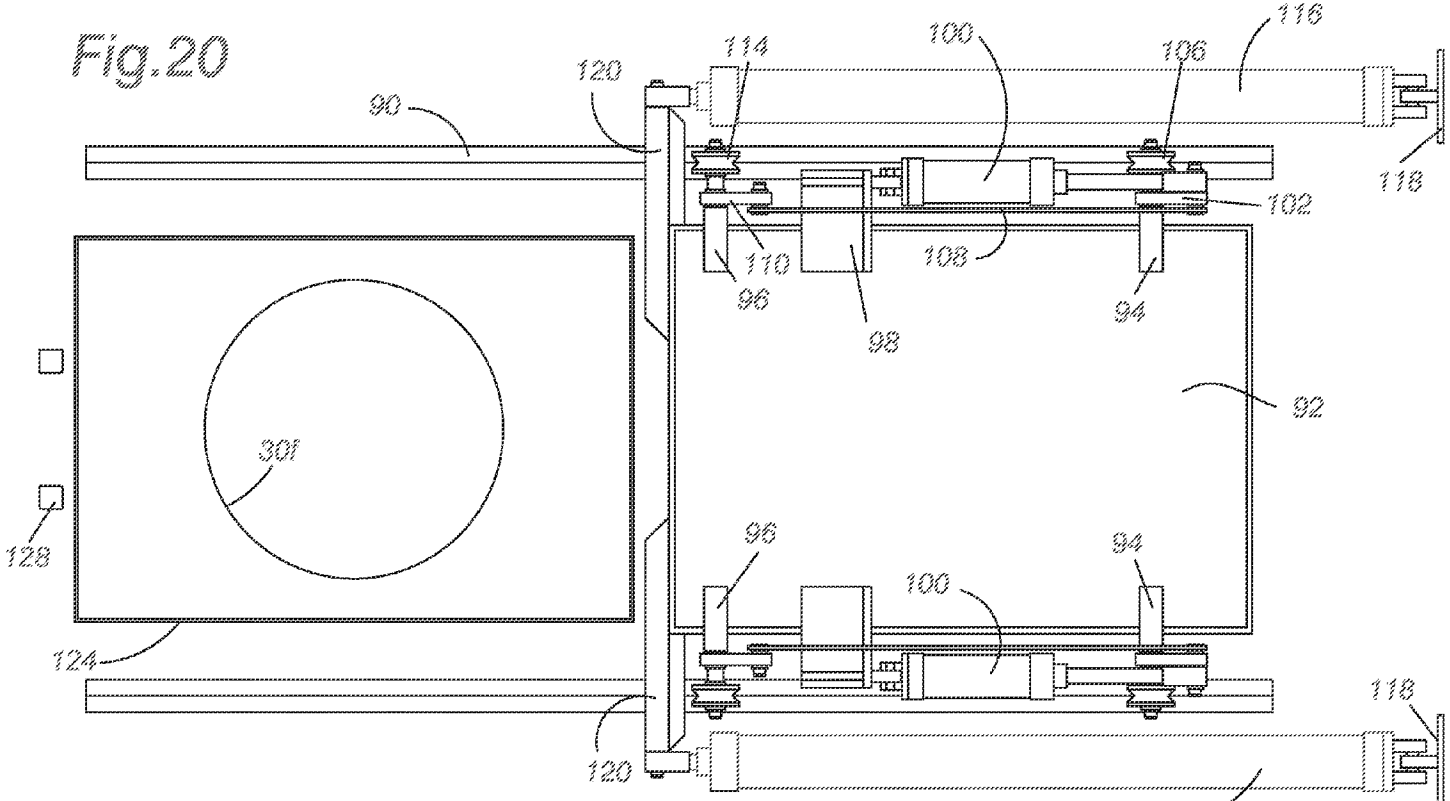
FIG. 20 is a top plan view similar to FIG. 16 but showing the access door in a raised and retracted position to exposed access to the storage silo mouth.
Figure 21:
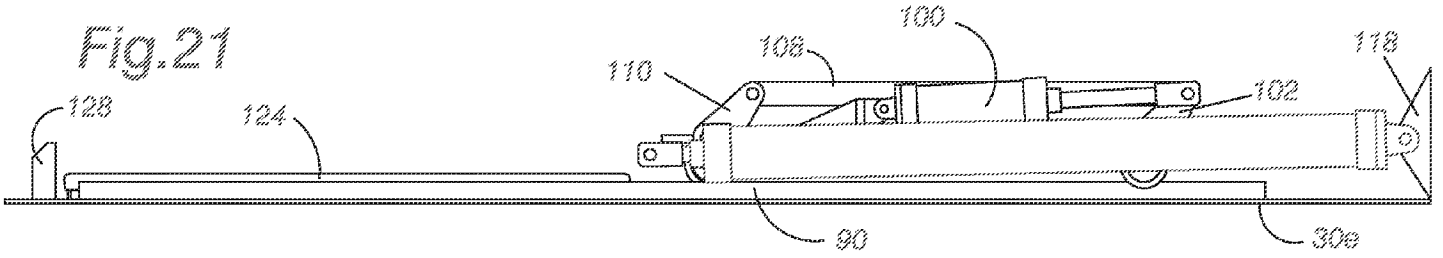
FIG. 21 is a side elevational view similar to FIG. 17 but showing the access door in a raised and retracted position to exposed access to the storage silo mouth.

The retracted position is illustrated in FIGS. 20-21. With the door panel 92 elevated as shown in FIGS. 16-19, the elongate cylinders 116 are actuated to retract. This action pulls the door panel 92 away from registry with the central opening 30*f* of the storage bin 30 as the door panel 92 is carried by the v-groove wheels 106 & 114 on the tracks 90 moving from left to right as viewed in FIGS. 20-21.

From the retracted position to the sealed position is simply the foregoing steps in reverse. The elongate cylinders 116 extend to push the door panel 92 carried by the v-groove wheels 106 & 114 along the tracks 90 until the leading edge of the door panel 92 engages stop members 128 secured to the top closure 30*e*. At this position, the door panel 92 registers with the upstanding lip 30*g* frame surrounding the central opening 30*f* of the storage bin 30. After operation of the elongate cylinders 116, then the cylinders 100 are retracted to lower the door panel 92 until the sealing gasket 122 is forcibly biased against the cushion strip 124 of the upstanding lip 30*g* to create a positive and effective closure seal of the central opening 30*f* of the storage bin 30.

With a positive top seal to the storage bin 30, an effective inerting system as schematically illustrated in FIGS. 22-25 can be provided. In addition to the self-sealing closure door assembly 78 as previously described, the closure top 30*e* is equipped with a vent valve 130 and an oxygen sensor 132 to monitor the level of oxygen present in the interior of the storage bin 30 above the asphaltic mixtures 32 stored therein. A steam generator 134 is connected by a conduit 136 to the lower end of the frusto-conical portion 30*b* of the storage bin 30 for the delivery of steam thereto. A water supply 138 includes a conduit 140 for the delivery of water to the discharge gate 30*d* of the storage bin 30. An electronic process controller 142 is connected to the oxygen sensor 132, the steam generator 134 and optionally to the water supply 138. The process controller 142 functions to operate initial deliver of steam from the steam generator 134 to the storage bin 30 through conduit 136, to receive signals from the oxygen sensor 132 and to deliver steam from the steam generator 134 to the storage bin 30 if the oxygen level rises above a preselected level, and to initiate deliver of water 144 from the water supply 138 to the discharge gate 30*d* of the storage bin 30.

Figure 22:
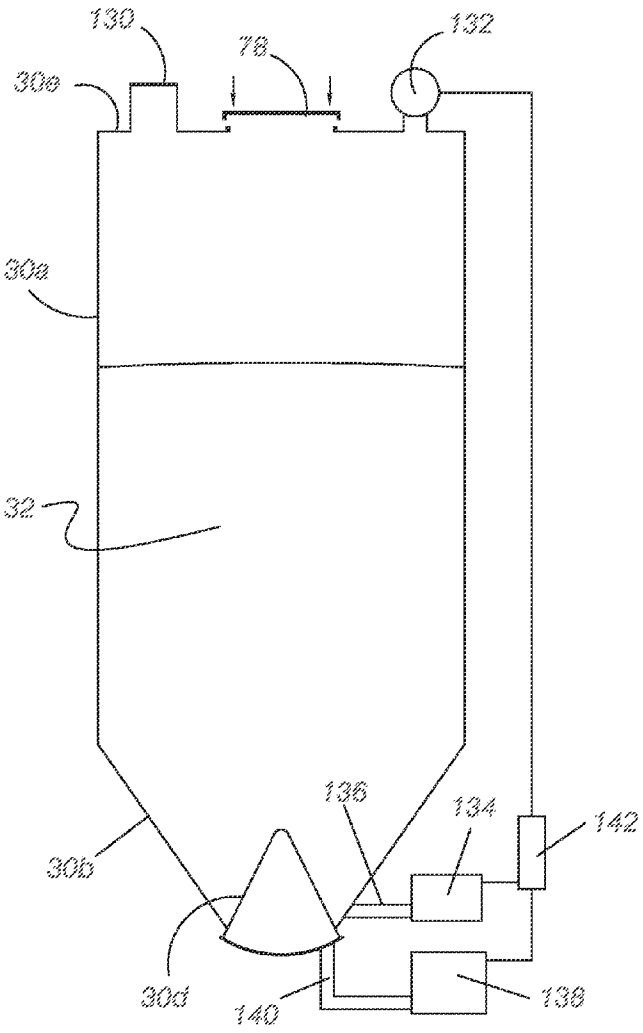
FIG. 22 is a side elevational, schematic view of an inerting system for an asphalt storage silo illustrating conditions of normal, daily operation.
Figure 25:
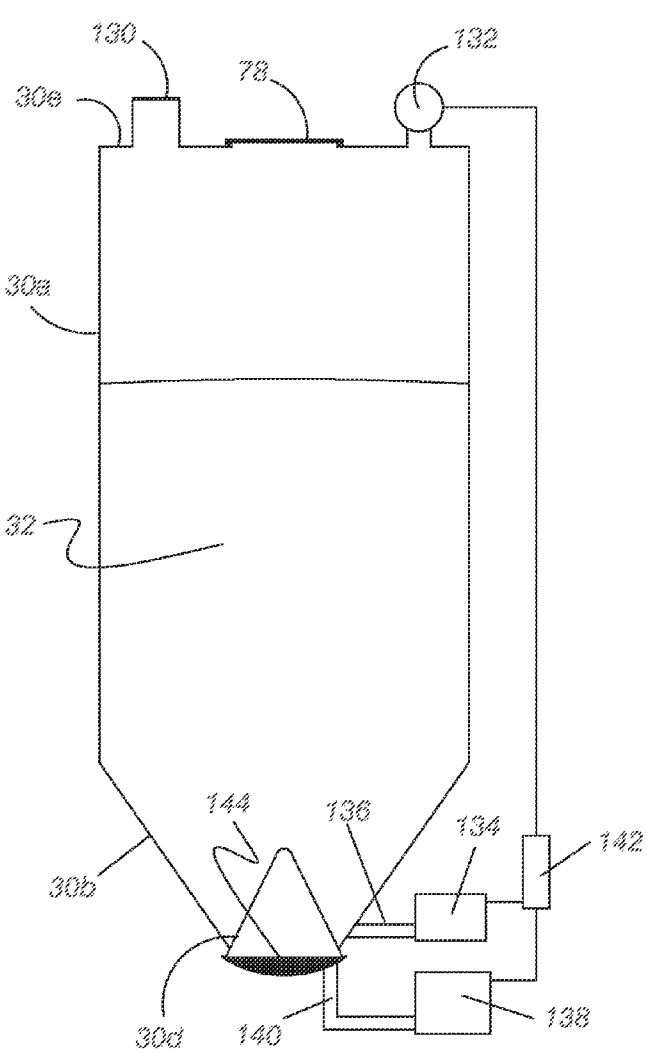
FIG. 25 is a side elevational, schematic view of an inerting system for an asphalt storage silo illustrating conditions of prolonged inert storage operation.

During normally daily operations at an asphalt plant equipped with the asphalt distribution and storage system as previously described, the storage bin 30 as shown in FIG. 22 can function with the opening and closing of the closure door assembly 78 to intermittently accept asphaltic mixtures 32 from the transport batcher 44 and to seal the top of the storage bin 30 to prevent emissions such as blue-smoke. Discharge gate 30*d* may be opened to dispense asphaltic mixtures 32 to trucks in the load-out area.

Figure 23:
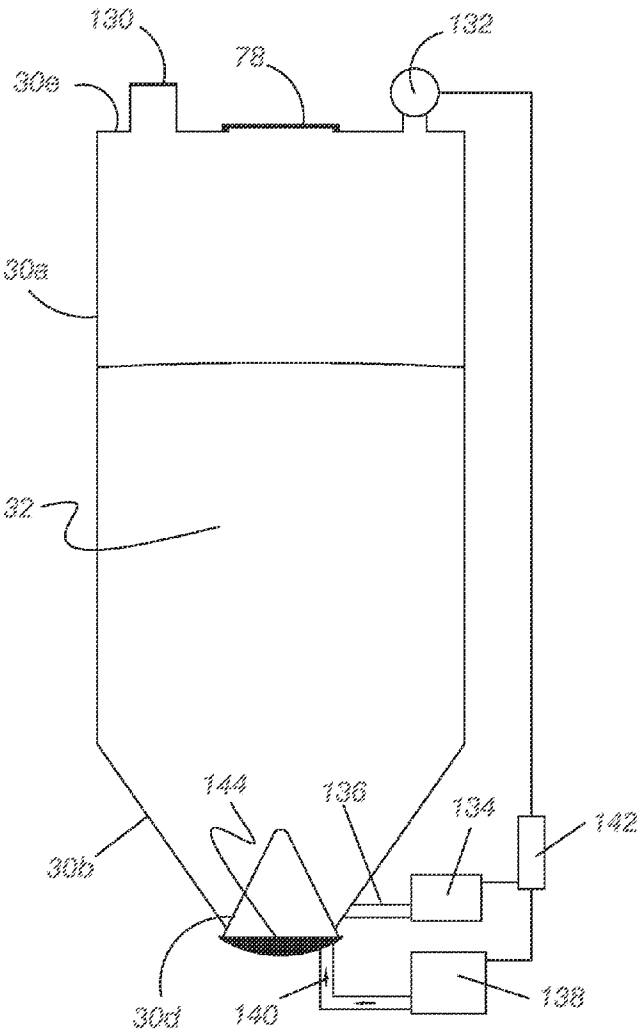
FIG. 23 is a side elevational, schematic view of an inerting system for an asphalt storage silo illustrating conditions of a sealed top access door and sealed lower discharge gate.

When prolonged periods of storage of the asphaltic mixtures 32 are contemplated, the first critical step is to activate the closure door assembly 78 to affect a positive seal over the central opening 30*f* of the storage bin 30. Next, the process controller 142 causes the water supply 138 to deliver water 144 through conduit 140 to the discharge gate 30*d* in order to create a water seal around the central discharge mouth 30*c* of the storage bin 30. This condition is illustrated in FIG. 23 and effectively isolates the interior of the storage bin 30 from its outside environment.

Figure 24:
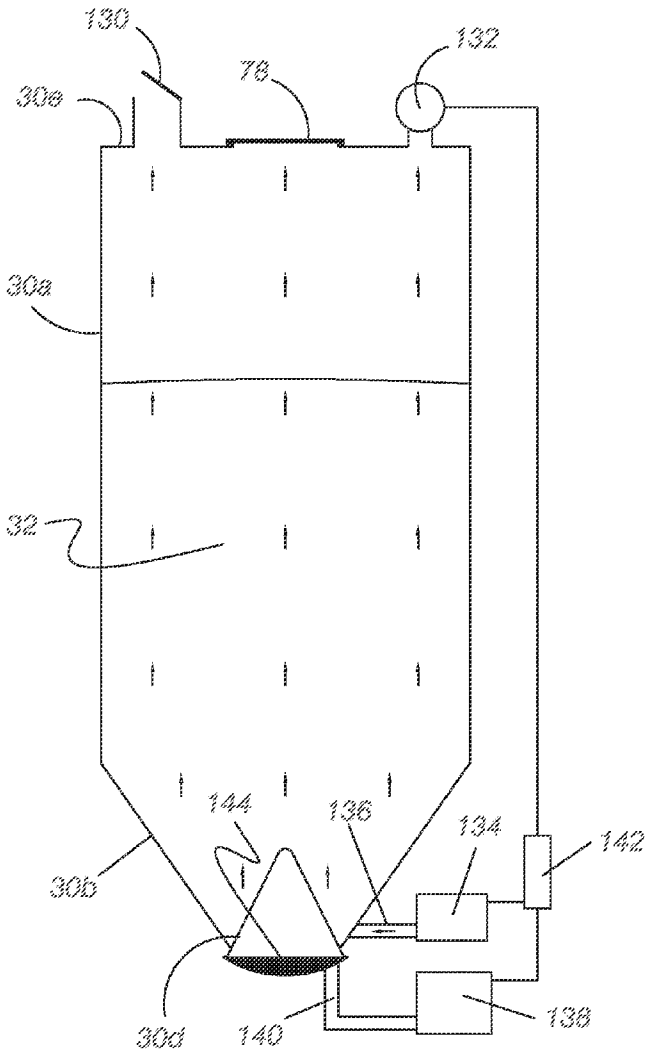
FIG. 24 is a side elevational, schematic view of an inerting system for an asphalt storage silo illustrating conditions introducing an inert fluid into the storage silo.

Next, the process controller 142 causes the steam generator 134 to deliver steam through conduit 136 to the lower end of the storage bin. The vent valve 130 is opened. As the steam percolates up through the asphaltic mixtures 32, the ambient atmosphere containing oxygen within the asphalt mixtures 32 and the interior volume of the storage bin 30 above the level of asphaltic mixtures 32 is displaced and vented through the vent valve 130. This condition is illustrated in FIG. 24.

Thereafter, when the oxygen sensor 132 signals that the oxygen level within the storage bin 30 is below a preselected level, the vent valve 130 is closed and the storage bin 30 is secured for a prolonged period where oxidation of the asphaltic mixtures 32 is minimized. During such prolonged storage, the process controller 142 may continue to monitor the oxygen level sensed by the oxygen sensor 132 and may periodically cause the steam generator 134 to deliver additional steam to the interior of the storage bin 30 and to vent interior gases through vent valve 130 until inert conditions are restored within the storage bin 30.

In operation, the multi-silo distribution and storage system receives asphaltic mixtures 32 from the production plant via the drag slat conveyor 34. The asphalt mixtures 32 are first accumulated in the stationary batcher 46. When the transport batcher 44 is aligned under the stationary batcher 46, the clamshell gates of the stationary batcher 46 may be opened to discharge a load of asphaltic mixtures 32 to the transport batcher 44. Opening of the clamshell gates 52 of the stationary batcher 46 automatically causes the bellows 60 mounted thereon to seal against the cover plate 44*d* of the transport batcher 44 to control blue-smoke emissions.

Once loaded and with its movable central doors 44*g* sealed, the transport batcher 44 can either remain in position at the first storage bin 30 over which the conveyor 34 is positioned, or travel on the rails 36 & 40 to any preselected storage bin 30 in the bank of bins 30. When positioned above a preselected bin 30, the movable door assembly 88 associated with that bin 30 is operated to first elevated the sealing door panel 92 and to then horizontally move the door panel 92 away from the central opening 30*f* of the storage bin 30. As the clamshell gates 52 of the transport batcher 44 open, the bellows 60 automatically deploys downwardly to seal against the top plate 82 of the closure door assembly 78 to control blue-smoke emissions. Once the load is transferred from the transport batcher 44 to the storage bin 30, the movable door assembly 88 is again operated to first move the door panel 92 over the central opening 30*f* of the storage bin 30 and to then vertically move the door panel 92 downwardly to create a positive and continuous seal over the central opening 30*f*. The transport batcher 44 can then be directed to return to the stationary batcher 46 on rails 36 & 40 for another load.

It will be understood that during normal plant operations, trucks may drive into the load-out area beneath the bank of storage bins 30. Once a truck is positioned under a bin 30, its discharge gate 30*d* may be opened to deliver asphaltic mixtures 32 from the bin 30 to the truck. Such loading activities may go on continuously or sporadically throughout a normal work day.

When a prolonged period of storage is anticipated, such as overnight for example, the inverting system previously described can be implemented in order to control environmental emissions and to also protect the stored asphaltic mixtures 32 from oxidation. The storage bin 30 is effectively isolated with the fluid seal at the discharge mouth 30*c* and with the movable door assembly 88 sealing the top of the bin.

From the foregoing it will be seen that this invention is one well adapted to attain all the ends and objects hereinabove set forth, together with the other advantages which are obvious and which are inherent to the invention.

It will be understood that certain features and subcombinations are of utility and may be employed without reference to other features and subcombinations. This is contemplated by and is within the scope of the claims.

Since many possible embodiments may be made of the invention without departing from the scope thereof, it is understood that all matter herein set forth or shown in the accompanying drawings is to be interpreted as illustrative and not in a limiting sense.

Having thus described my invention, I claim:

1. A multi-silo asphalt distribution and storage system to receive asphalt mixtures by an elevating conveyor from an asphalt production plant, said multi-silo asphalt distribution and storage system comprising:

a plurality of large diameter, upright cylindrical storage bins for storing asphaltic mixtures, each said storage bin being supported above a truck load-out area and having a discharge gate to contain asphaltic mixtures within said storage bin when closed and to dispense asphaltic mixtures from said storage bin when opened, said storage bin also having a substantially circular top closure with a central opening therethrough;

a movable door mounted atop each of said storage bins to seal against said top closure when closed and to provide access to the interior of said storage bin when opened;

a stationary batcher positioned and supported above said storage bins, but remote therefrom, to receive and accumulate asphaltic mixtures from said elevating conveyor, said stationary batcher having an upright cylindrical portion with a diameter smaller than said storage bin diameter, a frusto-conical discharge mouth joined to said cylindrical portion, and clamshell gates to contain asphaltic mixtures within said stationary batcher when closed and to discharge asphaltic mixtures from said stationary batcher when opened;

an indexing rail system mounted atop said storage bins;

a transport batcher carried on said indexing rail system and interposed between said stationary batcher and said storage bins, said transport batcher movably positionable on said rail system beneath said stationary batcher to receive asphaltic mixtures therefrom and then movably positionable on said rail system above a preselected one of said plurality of storage bins to then discharge the asphaltic mixtures from said transport batcher to the storage bin so as to prevent segregation of the asphaltic mixtures discharged to the storage bin, said transport batcher having an upright cylindrical portion with a diameter smaller than said storage bin diameter, a frusto-conical discharge mouth joined to said cylindrical portion and sized to discharge asphaltic mixtures through said central opening in the storage bin top closure, and clamshell gates to contain asphaltic mixtures within said transport batcher when closed and to discharge asphaltic mixtures from said transport batcher when opened; and a flexible, cylindrical bellows connected to and supported on said transport batcher to be lowered onto and sealed against said top closure of said storage bin whenever said clamshell gates of said batcher are opened to discharge asphaltic mixtures to said storage bin;

whereby said bellows isolates the region between said transport batcher and storage bin from the environment during discharge of asphaltic mixtures from said transport batcher to said storage bin in order to control blue-smoke emissions.

2. The multi-silo asphalt distribution and storage system as in claim 1, including a cylindrical shroud attached to said upright cylindrical portion of said transport batcher and extending downwardly therefrom, said bellows being fabricated from accordion fold material having an upper end attached to said shroud and having a lower cuff containing a hoop-shaped weight to cause said accordion fold material to unfold by gravity whenever said clamshell gates of said transport batcher are opened to discharge asphaltic mixtures to said storage bin and to seal against said top closure of said storage bin.

3. The asphalt distribution and storage system as in claim 2, said lower cuff and weight of said bellows connected to a plurality of cables, each such cable being threaded over a pulley and secured to one of said clamshell gates of said transport batcher such that as said clamshell gates open, said bellows unfolds to seal against said top closure of said storage bin, and as said clamshell gates close, said cables pull said bellows upwardly toward said shroud.

4. The multi-silo asphalt distribution and storage system as in claim 1 further including a second flexible, cylindrical bellows connected to and supported on said stationary batcher to be lowered onto and sealed against the top of said transport batcher whenever said clamshell gates of said stationary batcher are opened to discharge asphaltic mixtures to said transport batcher, whereby said second bellows isolates the region between said stationary batcher and said transport batcher from the environment during discharge of asphaltic mixtures from said stationary batcher to said transport batcher in order to control blue-smoke emissions.

5. The multi-silo asphalt distribution and storage system as in claim 4, including a cylindrical shroud attached to said upright cylindrical portion of said stationary batcher and extending downwardly therefrom, said bellows being fabricated from accordion fold material having an upper end attached to said shroud and having a lower cuff containing a hoop-shaped weight to cause said accordion fold material to unfold by gravity whenever said clamshell gates of said stationary batcher are opened to discharge asphaltic mixtures to said transport batcher and to seal against the top of said transport batcher.

6. The asphalt distribution and storage system as in claim 5, said lower cuff and weight of said bellows connected to a plurality of cables, each such cable being threaded over a pulley and secured to one of said clamshell gates of said stationary batcher such that as said clamshell gates open, said bellows unfolds to seal against the top of said transport batcher, and as said clamshell gates close, said cables pull said bellows upwardly toward said shroud.

* * * * *